US010295294B2

(12) United States Patent
Righi et al.

(10) Patent No.: US 10,295,294 B2
(45) Date of Patent: May 21, 2019

(54) ELECTRONIC DEVICE FOR A FIREARM

(71) Applicant: FABBRICA D'ARMI PIETRO BERETTA S.P.A., Gardone Val Trompia, Brescia (IT)

(72) Inventors: Eugenio Righi, Brescia (IT); Valentina Chiodi, Brescia (IT); Ettore Andreis, Brescia (IT); Andrea Candian, Brescia (IT)

(73) Assignee: FABBRICA D'ARMI PIETRO BERETTA S.P.A., Gardone Val Trompia, Brescia (IT)

( * ) Notice: Subject to any disclaimer, the term of this patent is extended or adjusted under 35 U.S.C. 154(b) by 0 days.

(21) Appl. No.: 15/573,145

(22) PCT Filed: Mar. 30, 2016

(86) PCT No.: PCT/IB2016/051789

§ 371 (c)(1),
(2) Date: Nov. 10, 2017

(87) PCT Pub. No.: WO2016/181236

PCT Pub. Date: Nov. 17, 2016

(65) Prior Publication Data

US 2018/0120047 A1 May 3, 2018

(30) Foreign Application Priority Data

May 14, 2015 (IT) ..... BS2015A0084

(51) Int. Cl.
*F41A 35/00* (2006.01)
*F41A 19/01* (2006.01)
(Continued)

(52) U.S. Cl.
CPC ..... *F41A 35/00* (2013.01); *F41A 9/61* (2013.01); *F41A 19/01* (2013.01); *F41A 9/65* (2013.01)

(58) Field of Classification Search
CPC .... F41A 9/62; F41A 35/00; F41A 9/61; F41A 19/01
(Continued)

(56) References Cited

U.S. PATENT DOCUMENTS 5,083,939 A * 1/1992 Ittah ..... H01R 12/777 439/496
5,179,235 A * 1/1993 Toole ..... F41G 1/35 362/110
(Continued)

FOREIGN PATENT DOCUMENTS

EP 2354748 A1 8/2011
WO 0036359 A2 6/2000

*Primary Examiner* — Reginald S Tillman, Jr.
(74) *Attorney, Agent, or Firm* — Arent Fox LLP; Michael Fainberg

(57) ABSTRACT

An electronic a device for a firearm having a grip. The electronic device comprises a firearm element housable in a housing specifically formed in the grip of the firearm. The firearm element comprises a power supply battery and comprises a firearm interface port for access to said power supply battery. The electronic device comprises a base element engageable to the grip, housable in a firearm base that comprises a base interface port suitable to be operatively connected with the firearm interface port. In the reciprocal engagement between the firearm element and the base element through the firearm interface port and base interface port, the base element is suitable to electrically recharge the power supply battery.

9 Claims, 8 Drawing Sheets

(51) Int. Cl.
*F41A 9/61* (2006.01)
*F41A 9/65* (2006.01)

(58) Field of Classification Search
USPC ..... 42/84, 1.01, 1.02
See application file for complete search history.

(56) References Cited

U.S. PATENT DOCUMENTS

| | | | | |
|---|---|---|---|---|
| 5,704,153 | A * | 1/1998 | Kaminski | F41A 17/063 42/117 |
| 6,267,602 | B1 * | 7/2001 | Mendelson | H01R 13/6205 439/38 |
| 8,261,666 | B2 * | 9/2012 | Garg | F41A 9/65 102/502 |
| 10,088,269 | B2 * | 10/2018 | Sheets, Jr. | F41C 23/10 |
| 2002/0170220 | A1 | 11/2002 | Recce | |

* cited by examiner

ELECTRONIC DEVICE FOR A FIREARM

CROSS-REFERENCE TO RELATED APPLICATIONS

This application is the U.S. National Stage Application of International Patent Application No. PCT/IB2016/051789, filed on Mar. 30, 2016, which claims priority to Italian Patent Application No. BS2015A000084, filed on May 14, 2015, the contents of each of which is incorporated herein by reference in its entirety.

TECHNICAL FILED

The present invention relates to an electronic device for a firearm specifically suitable to detect and process events occurring to the firearm and suitable to allow the electrical recharging required for its operation. The present invention also relates to a gun, comprising a firearm element of the electronic device and a firearm base comprising a base element of the electronic device.

BACKGROUND

In the art, electronic devices are known suitable to operate with firearms of various types, for example suitable to locate the firearm, detect a shot fired, count the number of shots fired or the like.

The electronic devices in question, in order to work effectively in mobility typically have a power supply and recharging unit, for example a battery, of large size, to be charged and therefore, ready to fulfil the required functions. In other words, to function effectively and for long periods of time, the known electronic devices are typically large.

It is intuitively understood that large-sized electronic devices are substantially undesirable both for the fact that they affect the geometry and behaviour of the firearm and because they are difficult to integrate into the firearm itself, especially when this is a gun.

SUMMARY

The purpose of this invention is to provide an electronic device in which the problem referred to above is effectively solved; in fact, the electronic device of this invention is suitable to provide simple and repeatable recharging, in order to maintain the power supply battery included in it always charged.

This purpose is achieved by means of an electronic device ccording to claim 1. In addition, this purpose is achieved through a firearm base and with a gun.

Further advantages and embodiments of the electronic device, the gun and the firearm base of this invention, will be apparent from the dependent claims comprising the set of annexed claims.

Furthermore, the characteristics and advantages of the of the electronic device, the gun and the firearm base will be apparent from the following description, given by way of non-limiting example, in accordance with the accompanying figures, in which:

DETAILED DESCRIPTION

Figure 1:
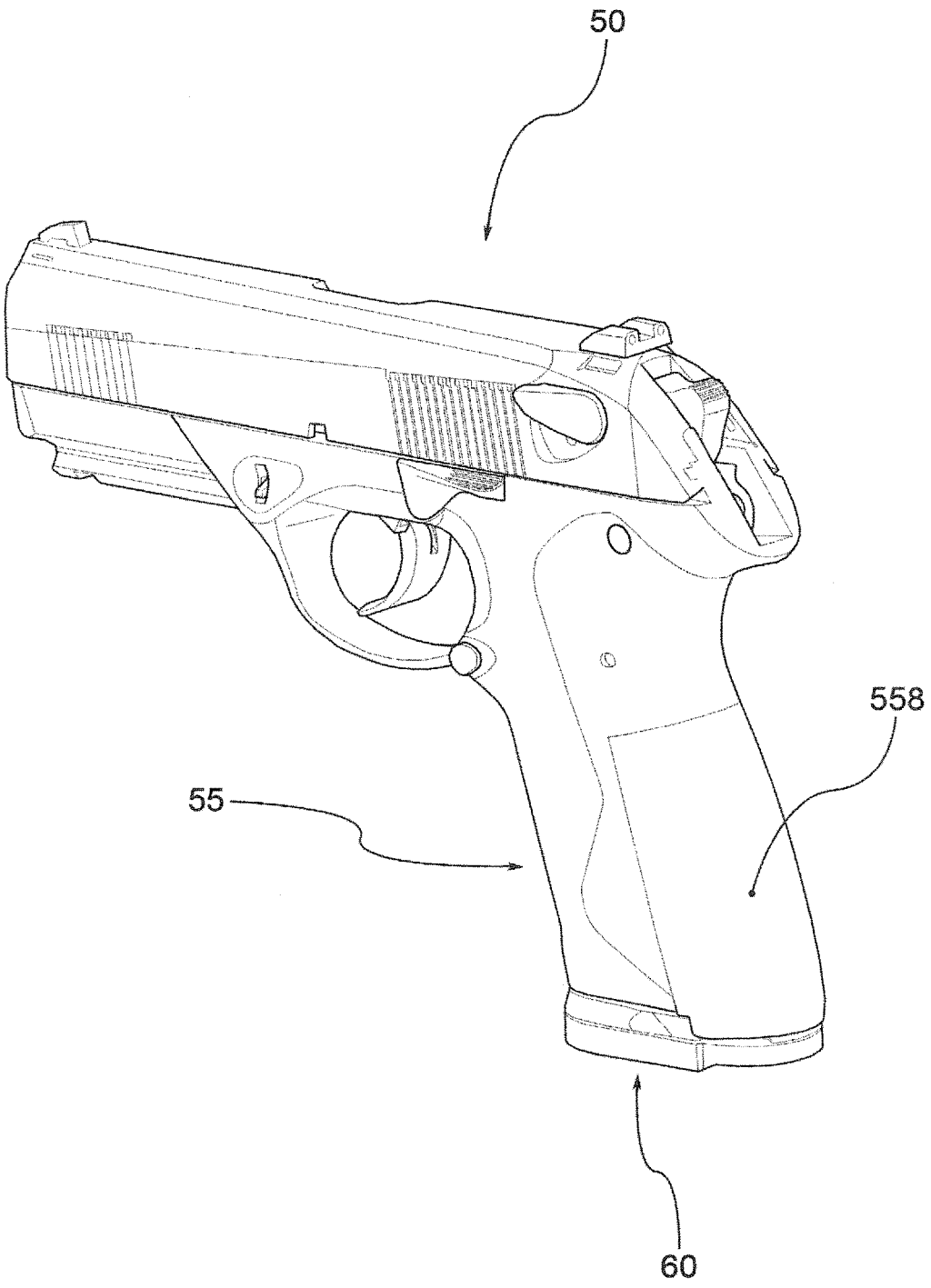
FIG. 1 is a perspective view of a gun housed on a firearm base weapon, in such a way that the respective components including the electronic device of this invention are in mutual interaction.
Figure 2A:
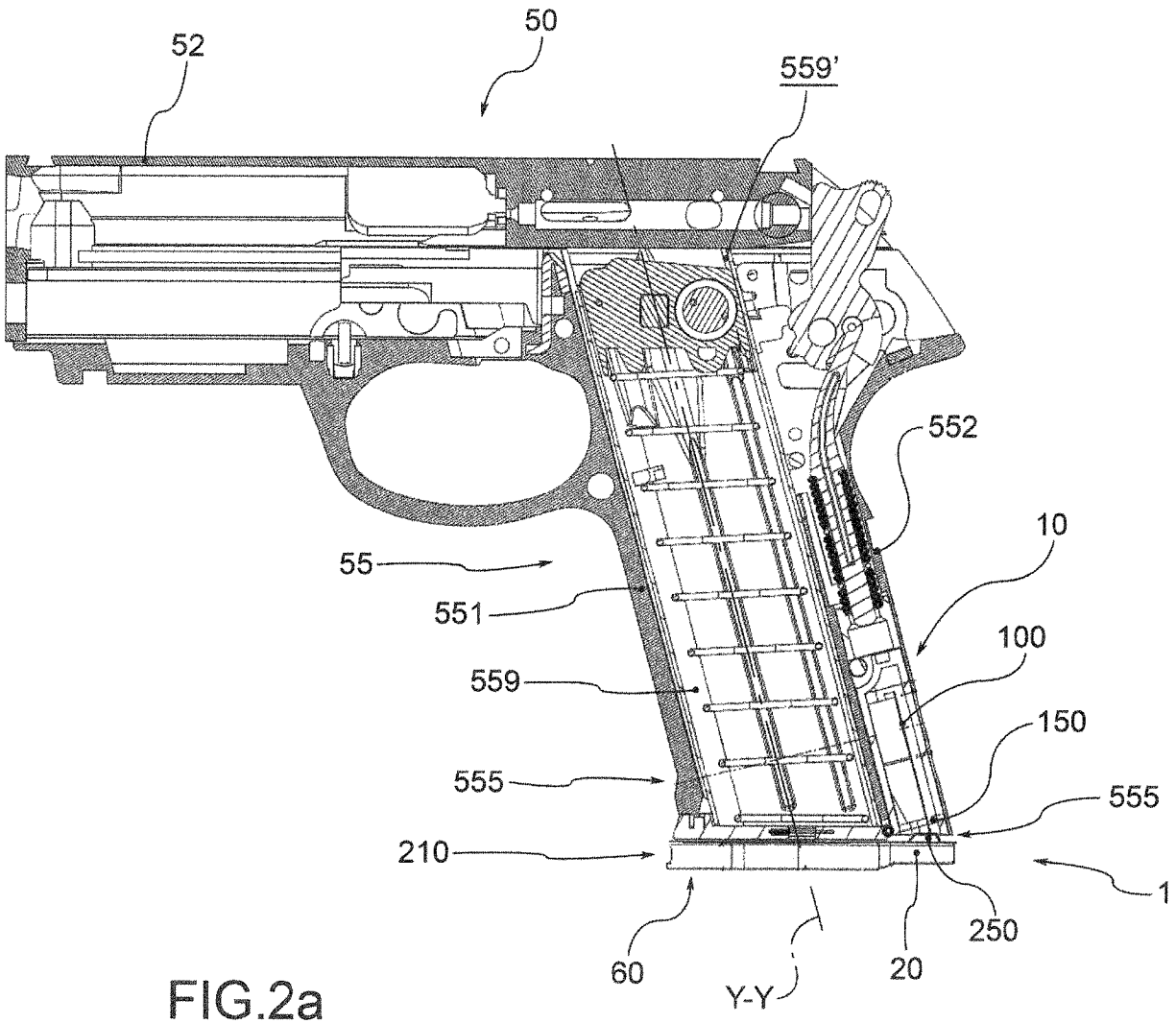
FIGS. 2*a*, 2*b* and 2*c* are respectively three side views in section of the gun and the firearm base according to three preferred embodiments, respectively in an embodiment wherein the base element supplies power using a power source, wherein the base element comprises a charging battery, wherein the base element cooperates with an emergency recharging battery, for example housed in the magazine.
Figure 2B:
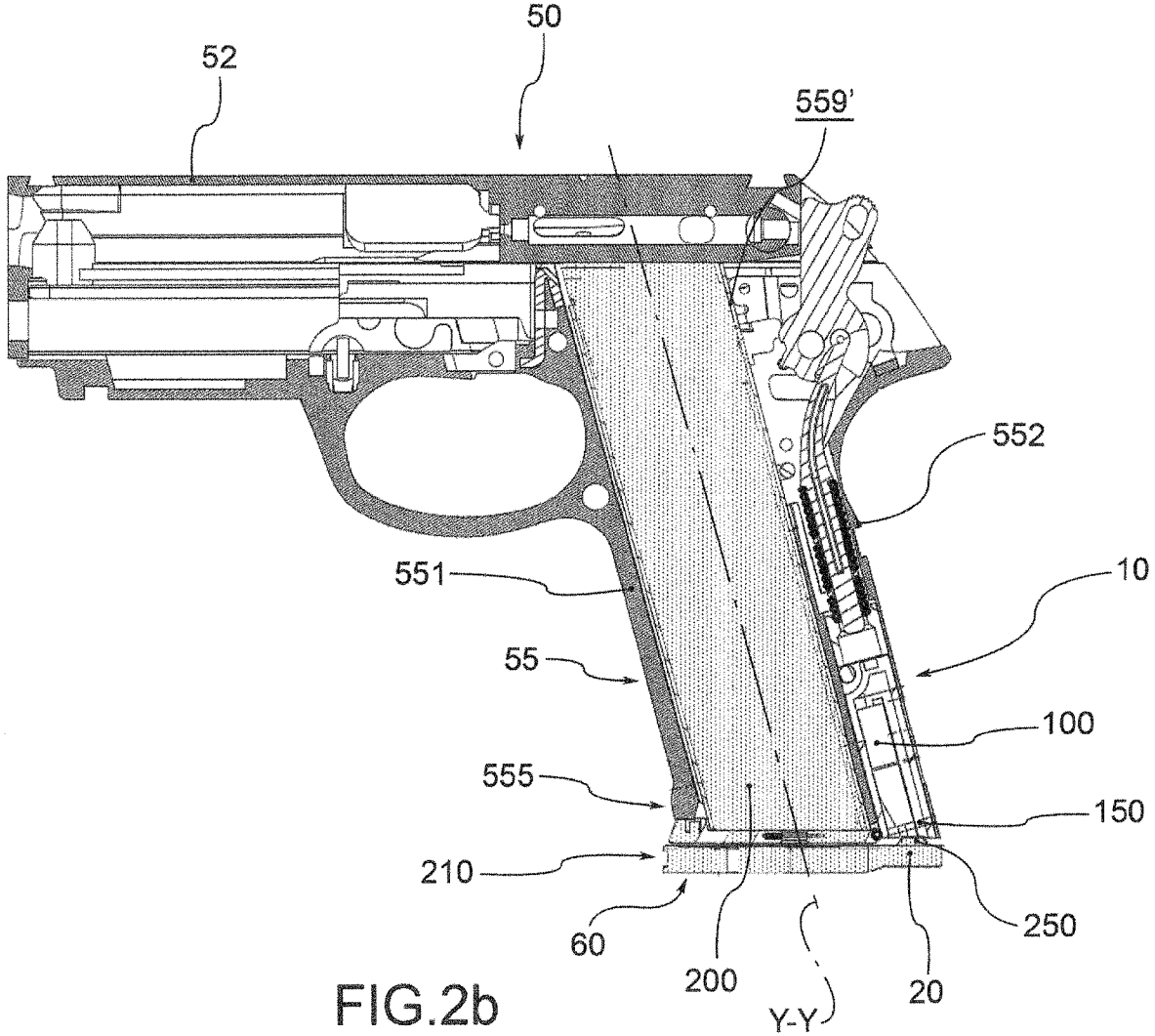
Figure 2C:
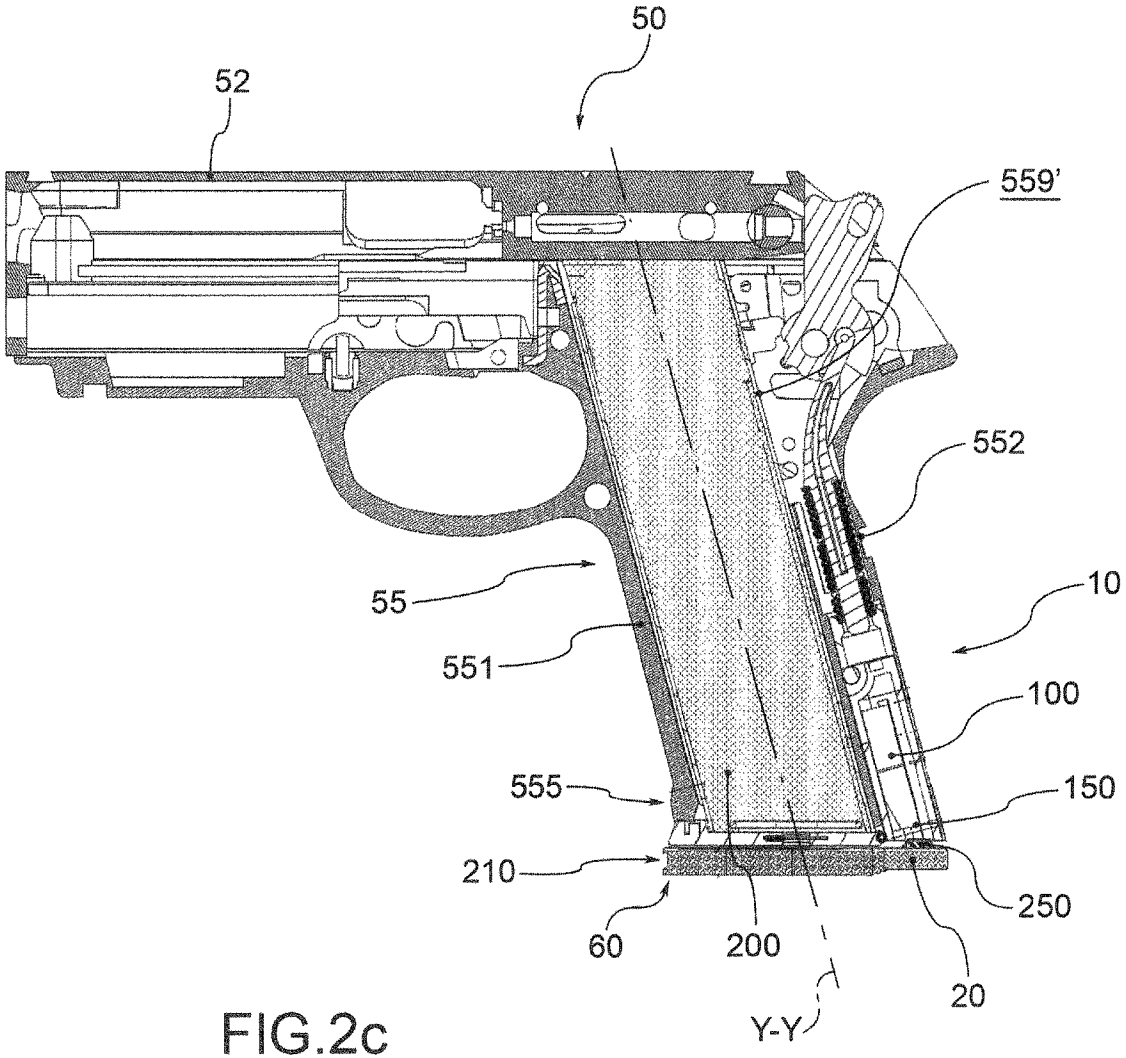
Figure 3A:
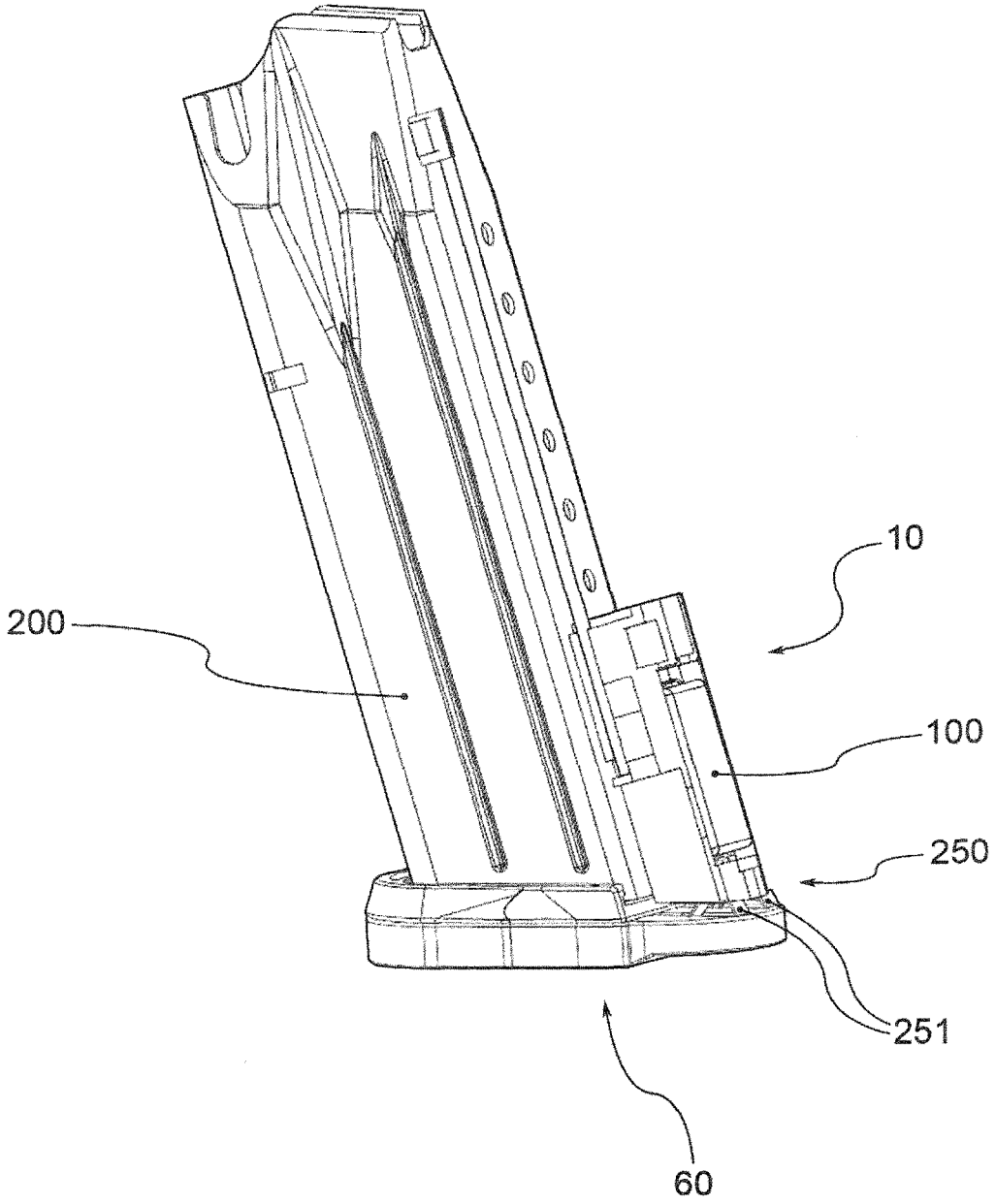
FIGS. 3*a* and 3*b* are respectively front and bottom views of an electronic device having a charging battery according to a preferred embodiment.
Figure 3B:
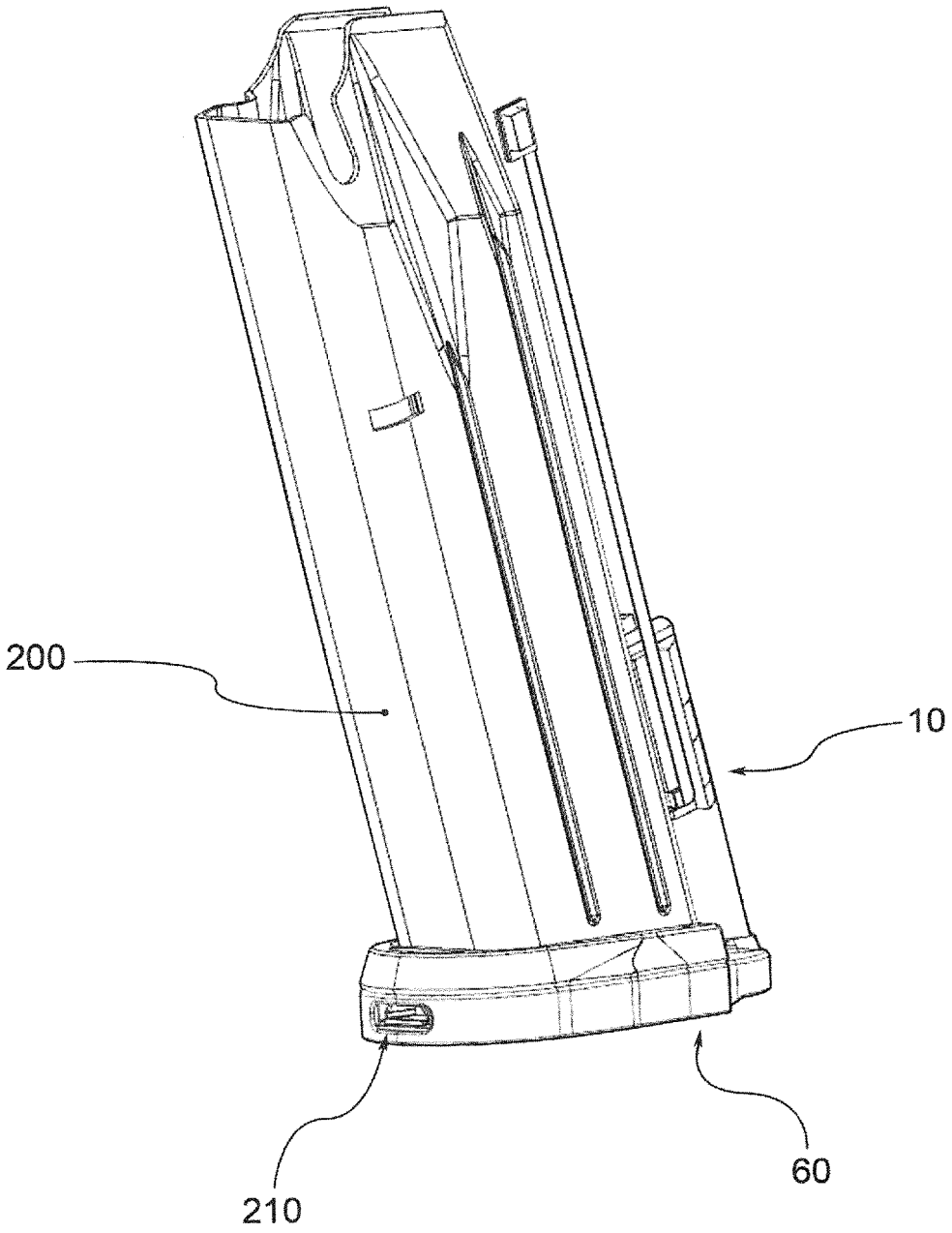
Figure 4B:
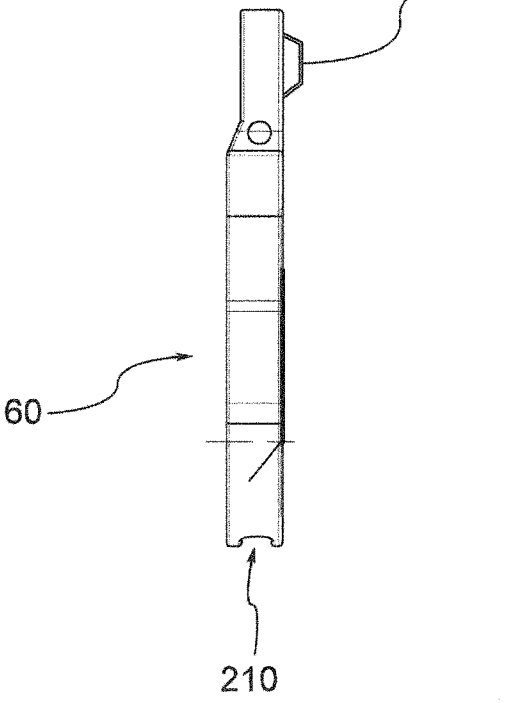
FIGS. 4*a* and 4*b* are respectively top and side views of a firearm base according to a preferred embodiment.
Figure 4A:
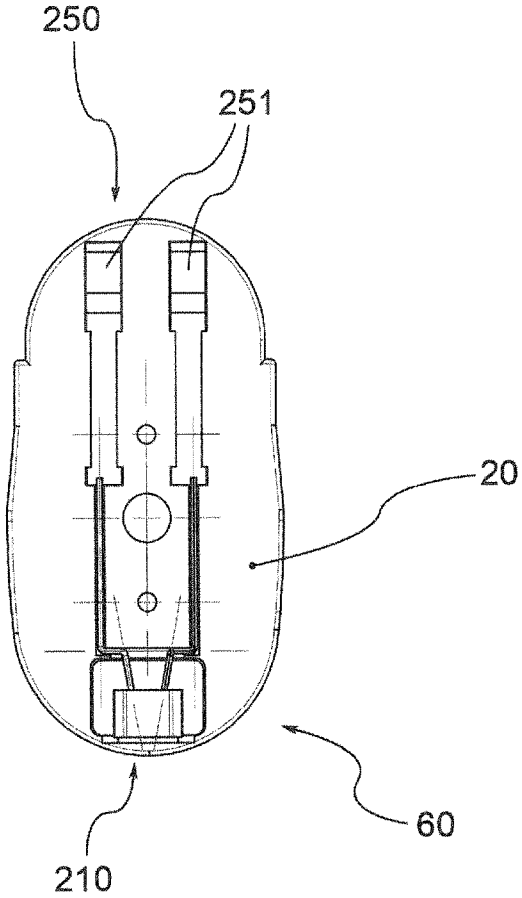
Figure 5:
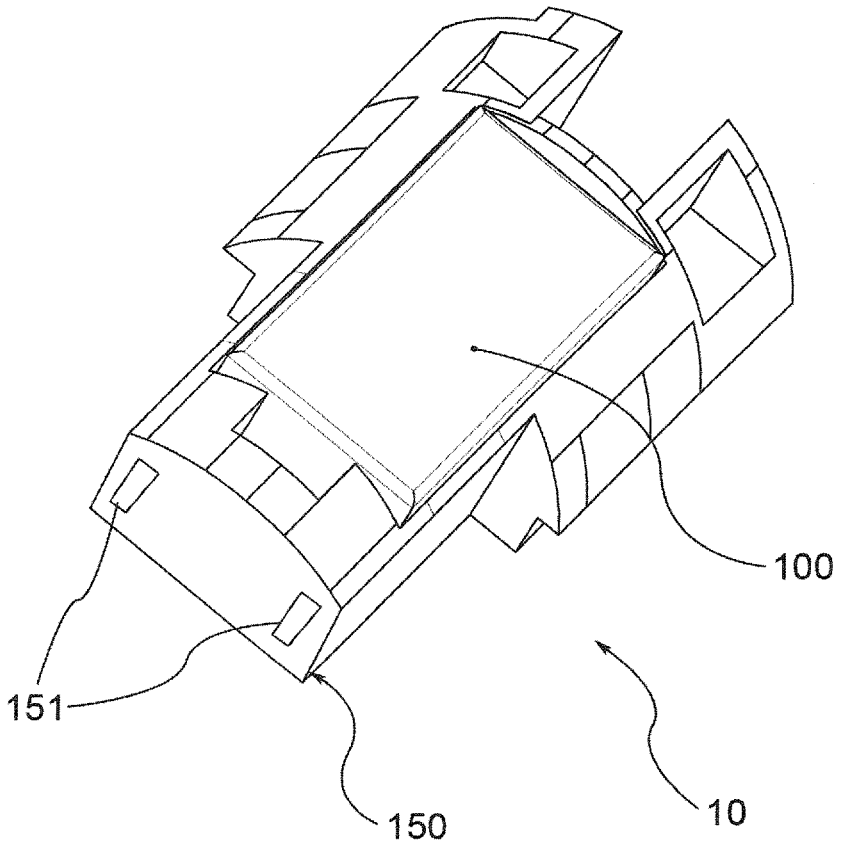
FIG. 5 is a perspective view of the firearm element housable inside a gun according to a preferred embodiment.

With reference to the accompanying figures, the reference number 1 indicates an electronic device for a firearm 50 in its entirety.

In a preferred embodiment, said firearm 50 is a gun.

Preferably, the electronic device 1 comprises two main portions suitable to interact, operatively connected, to one another.

In fact, according to a preferred embodiment, the electronic device 1 comprises a firearm element 10, for example suitable to detect and/or process one or more events occurring to the firearm 50.

In particular, the firearm element 10 comprises detection and processing means suitable to detect and process the firearm information. In particular, the detection and processing means comprise a specific electronic and/or mechanical component (not described or shown) suitable to detect information related to the state of the firearm in order to then place it at the service of the shooter and users in general. In an embodiment, the detection and processing means are suitable to detect and process the information of round in barrel, weapon ready to fire, weapon pointed, or the like. Preferably, the detection and processing means are suitable, for example, to assess the intensity of the accelerations experienced by the firearm, identifying a state of shot fired, and thus creating a specific shot fired information.

In addition, the detection and processing means comprise a specific component, preferably electronic (also not described or represented) for processing the firearm information created, for example the above-mentioned information of shot fired, for example by storing it. In fact, preferably, the firearm element 10, in particular in the detection and processing means, comprises memory means suitable to store the firearm information.

In addition, in a preferred embodiment, the firearm element 10 also comprises verification means suitable to verify and distinguish the type of action experienced by the firearm, for example, by distinguishing the firing event with respect to a misfire event or the firearm falling to the ground.

In fact, in a preferred embodiment, the firearm element 10 is suitable to be operatively connected with a mobile phone or smartphone, with which is respectively coupled, for example by "pairing". Preferably, the firearm element 10 is suitable to communicate with the mobile phone or smartphone with which it is coupled to mutually exchange information.

According to a preferred embodiment, the firearm element 10 is housable in a housing 510 specifically in the firearm 50, preferably in its grip 55.

In particular, in fact, the firearm 50 includes a stock 51 and a barrel 52 that extends along a firing axis X-X. The stock 51 comprises a grip 55 suitable to be gripped by the shooter. Preferably, the grip 55 extends along a grip axis Y-Y identifying a bottom 555 at its end opposite with respect to the barrel 52. In addition, the grip 55 has a distal portion 551 in the proximity of the trigger of the firearm and a proximal portion 552 next to the palm of the shooter's hand when holding the gun.

In a preferred embodiment, wherein the firearm 50 is a gun, the grip 55 comprises at least one grip plate 558 mountable on the gun to delimit and protect the housing recess 510 and removable from the gun 1 to allow access to the housing recess 510 and thus, for example, allow the insertion of the firearm element 10 in the gun.

Preferably, the grip plate 558 is snap-mountable on the grip 55. Preferably, the grip plate 558 is mountable with an action in the direction of the can be mounted with the direction of the firing axis X-X or the grip axis Y-Y.

In a preferred embodiment, inside the grip 55 is housed the magazine 559 of the firearm, preferably, in a specially shaped magazine housing 559'. In the embodiment wherein the firearm 50 is a gun, the magazine housing 559' extends along the grip axis Y-Y.

According to a preferred embodiment, the firearm element 10 comprises a power supply battery 100, specifically for its power.

In a preferred embodiment, the power supply battery 100 is of the type comprising lithium ions.

Preferably, the firearm element 10 comprises a firearm interface port 150 for access to said power supply battery 100.

According to a preferred embodiment, said firearm interface port 150 is formed on the bottom 555. Preferably, the firearm interface port 150 is flush with the bottom surface 555.

Preferably, the firearm interface port 150 comprises at least one firearm pin 151, preferably comprises two fire pins 151 placed at a distance from each other.

In a preferred embodiment, the electronic device 1 also includes a base element 20 suitable to be operatively connected with the firearm element 10.

Preferably, the base element 20 comprises a base interface port 250 suitable to engage with the firearm interface port 150.

According to a preferred embodiment, in the reciprocal engagement between the firearm element 10 and the base element 20 through the firearm interface port 150 and base interface port 250, the base element 20 is suitable to electrically recharge the power supply battery 100.

Preferably, the base interface port 250 comprises at least one base pin 251; in further embodiments, this comprises two base pins 251. In other words, the number of pins of the base interface port 250 is the same as the number of pins of the firearm interface port 251; i.e., the respective pins of the firearm element 10 and the base element 20 fit together for the mutual electrical interaction.

Basically, the firearm interface port 150 and the base interface port 250 are suitable to work together according to the plug-socket principle.

Preferably, the mutual engagement between firearm pin 151 and base pin 251 is mechanical. For example with a possible shape coupling thanks to the fact that one of the two is concave, while the other is convex. For example, the firearm pin 151 is flat or convex in such a way so as not to accumulate dirt inside it, while the base pin 251 has a substantially complementary shape. For example, conical, truncated-conical or spherical couplings between two reciprocal pins are foreseeable.

According to a preferred embodiment, the base pin 251 further comprises elastic elements suitable to allow a recovery of the construction tolerances and therefore to allow an always correct alignment between the firearm and base pins.

In a preferred embodiment, the firearm interface port 150 is also suitable to allow the transmission of data. In other words, in the operating engagement between firearm element 10 and base element 20, the base element 20 is suitable to access to data and information collected by the firearm element 10.

Preferably the transmission of data and information through the firearm interface port 150 is bi-directional also allowing the uploading of data and information into the firearm element 10, such as, for example, the uploading and/or updating of the internal software.

In other words, the firearm interface port 150 and base interface port 250 are mutually positioned relative to one another in such a way that the respective pins fit together and allow both the mutual electrical interaction of recharging and the interaction of data transmission.

According to a preferred embodiment, the base element 20 is engageable to the grip 55, in order to satisfy the characteristics of the electronic device 1 described above.

In a preferred embodiment, the base element 20 includes a main port 210 electrically connected with the base interface port 250.

Preferably, said main port 210 is suitable to be operatively connected to a power source, to provide electricity to the base element 20, and therefore when this is engaged with the firearm element 10 to allow recharging the power supply battery 100.

Preferably, according to a preferred embodiment, the main port 210 is also suitable to allow the transmission of data and information collected by the firearm element 10. In other words, data transmission is also allowed through the main port 210.

According to a preferred embodiment, the main port 210 is of the USB type.

In an embodiment, the base element 20 comprises a charging battery 200 suitable to permit recharging of the power supply battery 100 in a configuration having the firearm element 10 and base element 20 operatively connected.

In other words, thanks to the charging battery 200, the base element 20 is suitable to recharge the power battery 100 without requiring that the base element 20 be connected to a source of electricity.

Preferably, the charging battery 200 is rechargeable through the main port 210.

In a preferred embodiment, the charging battery 200 is of the type comprising lithium ions.

Preferably, the charging battery 200 is suitable to be housed in the magazine housing 559' of the firearm 50. In fact, in a preferred embodiment, the charging battery 200 has substantially the same shape as the magazine 559.

In a further embodiment, the charging battery 200 is contained in a magazine and the base element 20 is constituted, accordingly, comprising said magazine. In other words, the base element 20 comprises a magazine that, for a portion, is suitable to contain, inside it, a plurality of rounds while the remaining area contains a charging battery 200.

According to a preferred embodiment, the base element 20 is comprised in a firearm base 60, in such a way that the firearm 50 is insertable onto said firearm base 60. In other words, the base element 20 is housable in a firearm base 60 specifically suitable to engage the firearm 50, preferably the grip 55. In yet further other words, the firearm base 60 is suitable to receive the firearm 50, in particular its grip 55, to allow the mutual engagement of the base element 20 and the firearm element 10 for charging of the latter or for the use of the information collected in it.

Preferably, the firearm base 60 is therefore specifically suitable to support the firearm 50, for example when it is not used.

Thus, in a preferred embodiment, the surfaces of the firearm base 60 contain the base interface port 250 and/or the main port 210.

According to a preferred embodiment, the gun 50, slid out of the magazine 559, is suitable to be accommodated in the firearm base 60, in such a way that the charging battery 200 sits in the magazine housing.

In a preferred embodiment, the charging battery 200 is an emergency battery suitable to cooperate with the base element 20 for recharging the power supply battery 100.

In addition, according to further preferred embodiments, the base element 20 comprises alerting elements, such as a luminous element or an LED; these alerting elements are suitable to indicate the state of charge of the power supply battery 100. In other words, when the base element 20 is engaged with the firearm element 10, the first is suitable to indicate whether, and when, the power supply battery 100 is charged, for example, allowing the user to stop the charging operation.

Innovatively, the electronic device of this invention solves the typical problems of the known art, by comprising a firearm element, housable in the firearm and containing a power supply battery and a base element housable in a firearm base, suitable to be coupled and operatively connected with each other to recharge said power supply battery.

Advantageously, the firearm element and base element are provided with special interface ports in such a way as to ensure said precise coupling.

Moreover, advantageously, the charging operation is simple to perform and, therefore, easily repeatable.

A further advantage of the electronic device resides in the fact that the power supply battery is chargeable only through the base element, and not by means of a generic connection to the electric mains.

Advantageously, the firearm element and base element allow mutual bi-directional data transmission.

A further advantage of the electronic device resides, therefore, in the fact that access to the information collected by the firearm element occurs only through the base element.

In addition, advantageously, in the firearm there is no direct access socket that can be accessed to recharge and extract the information collected by the firearm element.

A further advantage, therefore, is that of having a secure firearm.

Advantageously, the only access to the firearm element is through firearm interface port, for example through the respective pins.

Moreover, advantageously, since there are no sockets formed on the firearm, there is no risk of dirt collecting inside them and, in fact, advantageously the access port is flush on the firearm or possibly convex.

A further advantageous aspect lies in the possibility that the main port is a USB type port.

A still further advantageous aspect resides in the fact that all the above-mentioned advantages are applicable to a gun; in fact, the lack of invasiveness of the electric device of this invention makes it applicable to a gun, in other words to a small firearm. Advantageously, the structure of the firearm is not significantly disturbed, except for the specific housing for containing the firearm element.

Moreover, advantageously, embodiments are foreseeable wherein the electronic device, in particular the base element, comprises a specific charging battery, allowing charging operations that do not require the access to the electric mains.

Advantageously, the electronic device is rechargable even in mobility, for example by replacing the magazine and coupling the firearm with the firearm base.

Furthermore, advantageously, when the firearm is not being used, it is accommodated on the specific firearm base to recharge the power supply battery. So, for example, it is foreseeable that, at the end of a shift, the shooter, for example a policeman, will put his firearm on the firearm base.

Advantageously, an event is foreseeable in which, with the firearm put back on the firearm base, the information collected by the firearm element is downloaded in its entirety.

Advantageously, the firearm element is suitable to operate in a plurality of detection, processing and storage modes of a multiplicity of firearm states.

Moreover, advantageously, the firearm element is rechargeable through the charging battery even when placed in a safe or similar, in other words when the firearm is placed in a secure housing location, for example in a specific armoury.

It is clear that one skilled in the art, in order to meet contingent needs, may make changes to the firearm described above, all contained within the scope of protection defined by the following claims.

The invention claimed is:

1. Electronic device for a firearm having a grip comprising:

a) a firearm element, configured to detect and/or manage one or more events occurring to the firearm, including an event of a shot fired, housable in a housing in the grip of the firearm, wherein the firearm element comprises a power supply battery and comprises a firearm interface port for access to said power supply battery, wherein the firearm interface port comprises at least one firearm pin flat or convex in such a way that is flush or convex with respect to the firearm in which the firearm element is housed;

b) a base element engageable to the grip, housed in a firearm base, comprising a base interface port that comprises at least one base pin, wherein the base pin has a substantially complementary shape of the respective firearm pin, wherein the base element comprises a main port electrically coupled to the base interface port, wherein the main port is configured to be operatively connected to a source of electricity, to provide electrical power to the base element, wherein the base pin further comprises elastic elements configured to allow correct alignment between the at least one firearm pin and the at least one base pin;

wherein, upon reciprocal engagement between the firearm element and the base element through the at least one firearm pin and the respective at least one base pin, the base element is configured to electrically recharge the power supply battery.

2. Electronic device according to claim 1, wherein the grip has a bottom, wherein the firearm interface port is on said bottom.

3. Electronic device according to claim 1, wherein the firearm interface port is configured to enable two-way data transmission, so that in the reciprocal engagement between the firearm element and base element, the base element is configured to access data and information collected by the firearm element or to supply information and data to the firearm element.

4. Electronic device according to claim 3, wherein the main port is configured to allow the electricity power supply of the power supply battery and the use of the data and information collected from the firearm element, wherein the main port is of a USB (Universal Serial Bus) type.

5. Electronic device according to claim 1, wherein the base element comprises a charging battery suitable to permit recharging of the power supply battery in a configuration having the firearm element and base element operatively connected.

6. Electronic device according to claim 5, wherein the charging battery is housed in a magazine housing of the firearm.

7. Electronic device according to claim 1, wherein the base element is comprised in a firearm base, in such a way that the firearm is insertable onto said firearm base.

8. Electronic device according to claim 1, wherein the firearm is a handgun.

9. A Handgun comprising:

a grip; and a firearm element, configured to detect and/or manage one or more events occurring to the handgun, including an event of a shot fired, housed in a housing in the grip of the handgun, wherein the firearm element comprises a power supply battery and comprises a firearm interface port for access to said power supply battery, wherein the firearm interface port comprises at least one firearm pin flat or convex in such a way that is flush or convex with respect to the handgun in which the firearm element is housed;

wherein the firearm element engages to a base element comprised of a base interface port having a base pin with a substantially complementary shape of the respective firearm pin and a main port electrically coupled to the base interface port, wherein the main port is configured to be operatively connected to a source of electricity, to provide electrical power to the base element, wherein the base pin further comprises elastic elements configured to allow correct alignment between the at least one firearm pin and the at least one base pin, wherein the power supply battery of the firearm element is configured to be electrically recharged by the base element upon reciprocal engagement between the firearm element and the base element through the firearm interface port and base interface port.

* * * * *